US008028377B2

(12) United States Patent
Baker

(10) Patent No.: US 8,028,377 B2
(45) Date of Patent: Oct. 4, 2011

(54) SHOE SUPPORT TERMINAL CONNECTION FOR BLOCK AND TACKLE BALANCE

(75) Inventor: Mark R. Baker, Rochester, NY (US)

(73) Assignee: Caldwell Manufacturing Company North America LLC, Rochester, NY (US)

( * ) Notice: Subject to any disclaimer, the term of this patent is extended or adjusted under 35 U.S.C. 154(b) by 604 days.

(21) Appl. No.: 12/022,565

(22) Filed: Jan. 30, 2008

(65) Prior Publication Data

US 2009/0188075 A1 Jul. 30, 2009

(51) Int. Cl.
*E05D 13/00* (2006.01)

(52) U.S. Cl. ..... 16/197; 49/445

(58) Field of Classification Search ..... 16/193, 16/196–199, DIG. 16, 202, 205, 206; 49/445, 49/446, 447

See application file for complete search history.

(56) References Cited

U.S. PATENT DOCUMENTS

| | | | | |
|---|---|---|---|---|
| 4,654,928 | A | 4/1987 | Flight | |
| 4,689,850 | A | 9/1987 | Flight | |
| 5,530,991 | A | 7/1996 | deNormand | |
| 6,041,476 | A | 3/2000 | deNormand | |
| 6,622,342 | B1 * | 9/2003 | Annes et al. | 16/197 |
| 6,820,368 | B2 * | 11/2004 | Uken et al. | 49/181 |
| 7,069,621 | B2 * | 7/2006 | Malek | 16/194 |
| 7,735,192 | B2 * | 6/2010 | deNormand | 16/197 |
| 2006/0000058 | A1 | 1/2006 | Robertson | |

* cited by examiner

*Primary Examiner* — William L. Miller
(74) *Attorney, Agent, or Firm* — Harness, Dickey & Pierce, P.L.C.

(57) ABSTRACT

In a block and tackle window balance, the balance shoe holds and upwardly biases the terminal connector in a mounted position. A biasing element of the shoe maintains the terminal connector in a pocket of the shoe during operation of the balance. The terminal connector is prevented from laterally exiting the pocket in the mounted position by a widened portion on the terminal connector and a locating surface extending from the shoe toward the pocket. Manually pressing down on the biasing element or the terminal connector itself to lower the terminal connector in the pocket until the widened portion clears the locating surface allows lateral removal of the terminal connector from the pocket. During operation of the balance, however, the terminal connector does not experience a sufficient downward force to overcome the upward bias such that the widened portion never clears the locating surface.

20 Claims, 6 Drawing Sheets

PRIOR ART

SHOE SUPPORT TERMINAL CONNECTION FOR BLOCK AND TACKLE BALANCE

BACKGROUND OF THE INVENTION

1. Field of the Invention

The invention pertains to the field of windows. More particularly, the invention pertains to a window balance.

2. Description of Related Art

Block and tackle window balances are compact in size and relatively easy to install. They use a system of pulleys and an extension spring to convert high spring tension applied over a short working distance to a lower spring tension applied over a longer working distance. Both the spring and the pulley system are arranged within a rigid U-shaped balance channel. One end of the extension spring is anchored at a first end of the balance channel, while the other end of the extension spring is mounted to an intermediate pulley or middle carriage of the pulley system. The second pulley of the pulley system is anchored at the second end of the balance channel. Generally, the balance channel is mounted in the jamb of the window frame and the cord for the pulley system is attached to a sash shoe that slides in the jamb with the sash. However, this arrangement can be reversed with the cord anchored to the top of the frame and the sash shoe anchored to the opposite end of the balance channel. In all cases, the extension spring and the pulley system are sized so that a desired lifting force is applied to the window sash throughout the entire range of sash travel in the window frame.

Referring to FIG. 1, a prior art block and tackle balance 110 is constructed from a channel 112, commonly formed from sheet metal, into which a spring 114 is assembled. The first spring end 114A of the spring 114 may be affixed by various means proximate a first end 112A of the channel 112. The second spring end 114B of the spring 114 is attached to a middle carriage 116, the middle carriage 116 including the first portion of a multi-part balance tackle assembly. An end axle 118, including a second portion of the multipart balance tackle assembly is affixed proximate a second end 112B of the channel 112. In conventional block and tackle balances, a sash cord 120 is affixed at one end to the middle carriage 116 and twice passes alternatively around sheaves including the end axle 118 and the middle carriage 116, exiting finally at the second end 112B of the channel 112, to form a five-part balance tackle assembly. A cord terminal 122 is affixed to the second end of the sash cord 120, to facilitate attachment of the sash cord 120 in the application of the counterbalance and to prevent the second end of the sash cord 120 from being retracted into the second end of the channel 112. The cord terminal 122 is then mounted in a carrier or balance shoe, which slides up and down a frame channel when the window is opened and closed.

In another prior art block and tackle balance, a cord terminal is mounted in a balance shoe 128, the top surface of which is shown in FIG. 2. The balance shoe 128 has a gap 146 for insertion of the cord terminal (not shown) and a pocket 148 for mounting the cord terminal in the balance shoe 128. The balance shoe 128 has flexible tabs 132, which help to maintain the mounted cord terminal in the pocket 148 of the balance shoe 128. The tabs 132 are flexible primarily in a direction perpendicular to the long axis of the pocket 148. These tabs 132 do not sufficiently limit motion of a mounted cord terminal in the pocket and have been found to break during usage in a block and tackle balance assembly. These tabs 132 also bear some of the load from the upward force of the block and tackle assembly as applied to the shoe by the cord terminal during operation.

There is a need in the art for a balance shoe design that durably and flexibly maintains a cord terminal in a mounted position in a balance shoe of a block and tackle balance assembly.

SUMMARY OF THE INVENTION

In a block and tackle window balance, the balance shoe holds and upwardly biases the terminal connector in a mounted position. A biasing element of the shoe maintains the terminal connector in a pocket of the shoe during operation of the balance. The terminal connector is prevented from laterally exiting the pocket in the mounted position by a widened portion on the terminal connector and a locating surface extending from the shoe toward the pocket. Manually pressing down on the biasing element or the terminal connector itself to lower the terminal connector in the pocket until the widened portion clears the locating surface allows lateral removal of the terminal connector from the pocket. During operation of the balance, however, the terminal connector does not experience a sufficient downward force to overcome the upward bias such that the widened portion never clears the locating surface.

In a first embodiment of the invention, the block and tackle window balance assembly includes a terminal connector attached to a sash cord and a balance shoe. The balance shoe includes a biasing element for biasing the terminal connector in an upward direction toward the sash cord in a mounted position in the balance shoe. When the terminal connector is in the mounted position, the terminal connector is only removable from the balance shoe by applying a downward force against the biasing element.

In a second embodiment of the invention, the block and tackle window balance assembly includes a terminal connector attached to a sash cord and a balance shoe. The balance shoe includes a biasing element for biasing the terminal connector in an upward direction toward the sash cord in a mounted position in the balance shoe. The balance shoe also includes a retaining surface for limiting upward movement of the terminal connector when mounted in the balance shoe. The balance shoe further includes a locating surface limiting lateral movement of the terminal connector in the balance shoe unless an upward bias of the biasing element is overcome such that the terminal connector is lowered from the mounted position and a widened portion of the terminal connector laterally clears the locating surface.

A method of assembling a block and tackle window balance includes inserting a terminal connector for attachment to a sash cord through a gap in a balance shoe. The method also includes moving the terminal connector laterally toward a pocket of the balance shoe with a widened portion of the terminal connector remaining below an extension on the balance shoe while a ridge of the connector increasingly applies a downward force to a biasing element of the balance shoe until the widened portion clears the extension. The method further includes raising the terminal connector upward in the pocket to a mounted position, thereby decreasing loading of the biasing element, wherein a retaining surface of the balance shoe limits upward movement of the terminal connector and a locating surface on the extension limits lateral movement of the widened portion when the terminal connector is in the mounted position.

A method of maintaining a terminal connector for a sash cord in a mounted position in a balance shoe of a block and tackle window balance assembly is also disclosed. The method includes applying an upward bias toward the sash cord to the terminal connector in the mounted position. The method also includes limiting lateral movement of the terminal connector in the mounted position by a locating surface extending from the balance shoe toward a widened portion of the terminal connector unless the upward bias is overcome such that the terminal connector is lowered from the mounted position and the widened portion laterally clears the locating surface.

DETAILED DESCRIPTION OF THE INVENTION

In an embodiment of the present invention, the shoe holds and upwardly biases the terminal connector in a shoe and terminal connector assembly for a block and tackle window balance. The terminal connector is preferably made of metal or plastic, and the shoe is preferably made of plastic. The upward biasing of the terminal connector by a biasing element of the shoe maintains the terminal connector in a pocket of the shoe during operation of the block and tackle balance. The terminal connector is prevented from laterally coming out of the pocket when in the mounted position by a widened portion on the terminal connector and a locating surface extending from the shoe toward the pocket. The terminal connector is easily removed by manually pressing down on the biasing element or the terminal connector itself to lower the terminal connector in the pocket until the widened portion on the terminal connector clears the locating surface, thereby allowing lateral removal of the terminal connector from the pocket. Although the terminal connector is easily removed manually from the shoe, during normal operation of the block and tackle balance the terminal connector does not experience a sufficient downward force to overcome the upward bias such that the widened portion of the terminal connector never clears the locating surface.

Figure 1:
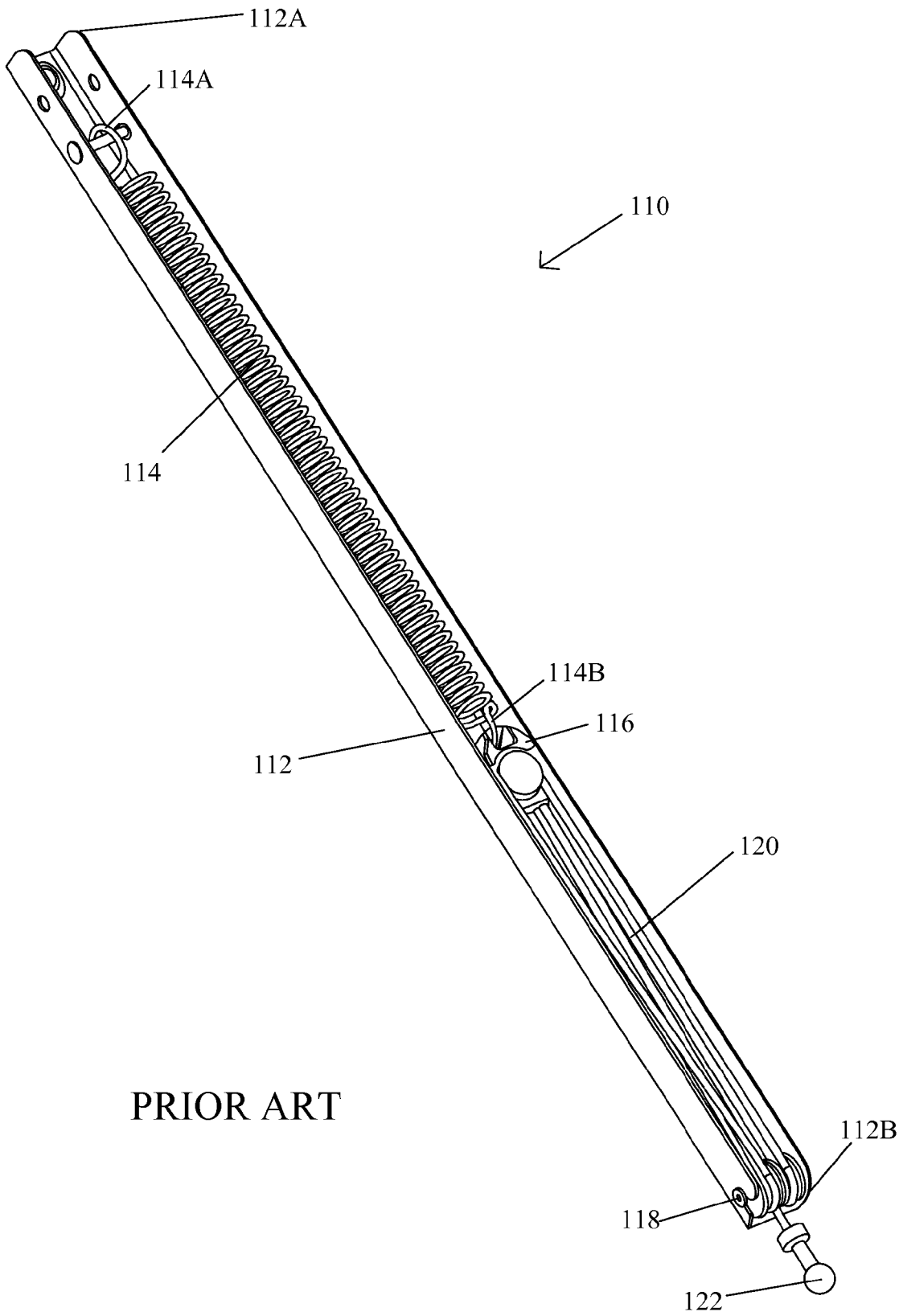
FIG. 1 shows a perspective view of a prior art block and tackle balance.
Figure 2:
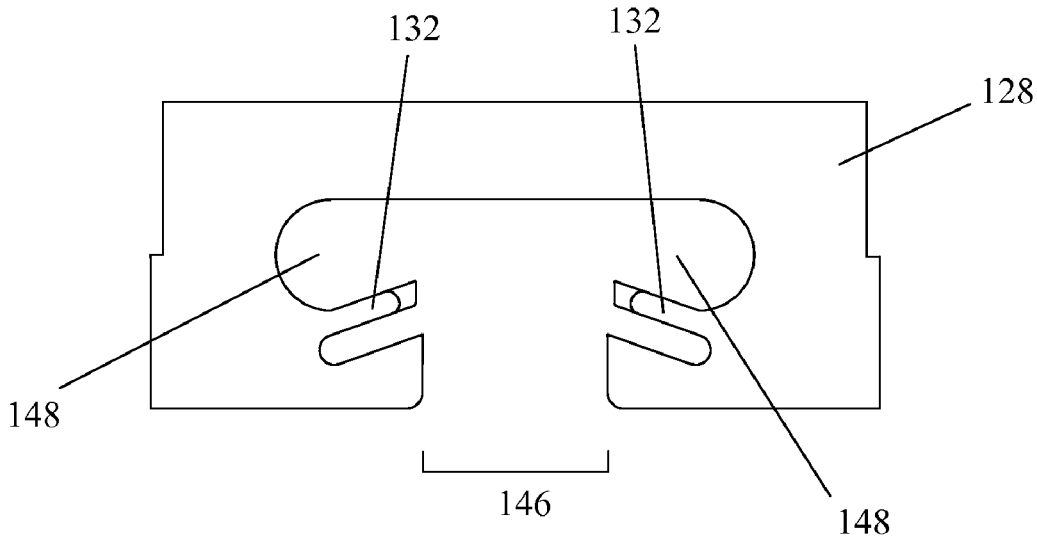
FIG. 2 shows a top view of the top surfaces of a prior art balance shoe.
Figure 7:
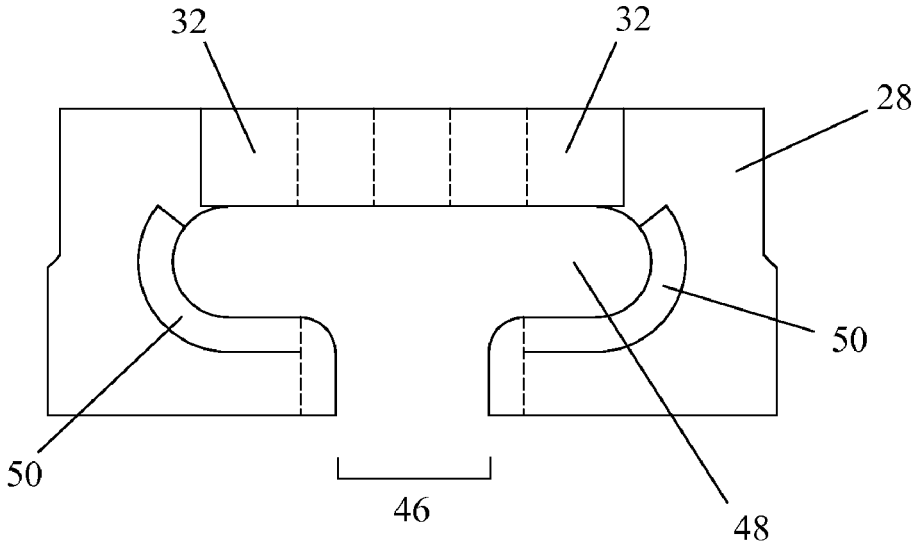
PRIOR ART Fig. 7
FIG. 7 shows a top view of the top surfaces of the shoe in the embodiment of FIGS. 3-6.

Referring to FIGS. 3 through 10, in an embodiment of the present invention, a sash cord 20 exits at the second end 22B of a channel 22 where it is attached to a terminal connector 24 with an axial bore, through which the cord 20 is threaded. The cord 20 is then knotted 26 to maintain the terminal connector 24 on the cord 20. In an alternate embodiment, the terminal connector is molded around the cord, as shown in FIG. 1. The terminal connector 24 is mounted to a balance shoe 28, which is mountable and slidable up and down in a frame channel. A retaining surface 30 in the shoe 28 and a widened portion 31 on the terminal connector 24 limit upward movement of the terminal connector 24 in the pocket 48 of the shoe 28. The shoe 28 also includes a biasing element, which in this embodiment is a flexible tab 32. The flexible tab 32 is located on a top surface of the shoe 28 and applies an upward biasing force on the terminal connector 24 by contacting a ridge 34 on the terminal connector 24, and resisting downward movement of the terminal connector 24 in the pocket 48. When the terminal connector 24 is mounted in the balance shoe 28, the tab 32 is preferably deflected slightly downward by the ridge 34 such that the terminal connector 24 is biased to be maintained in the balance shoe 28 in the position shown in FIG. 10. The flexible tabs 32 flex substantially in a vertical direction with respect to the shoe 28 to bias the terminal connector 24 in an upward direction, in contrast to the prior art shoe 128 of FIG. 2, in which the flexible tabs 132 flex substantially in a horizontal direction with respect to the shoe 128 to bias the cord terminal in an inward direction toward the pocket.

Figure 3:
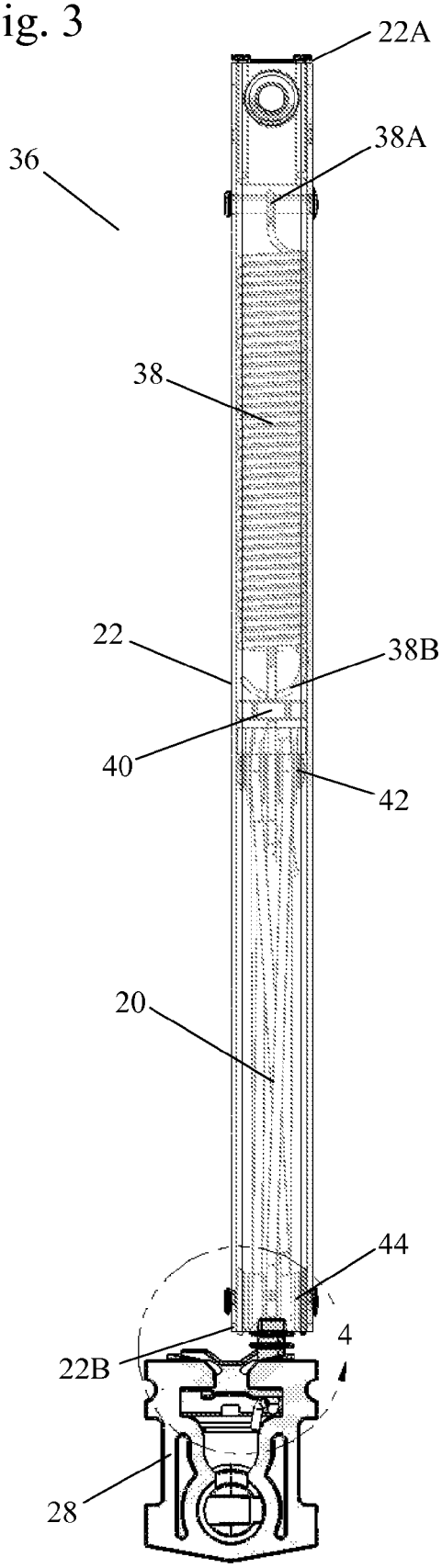
FIG. 3 shows a back view of a block and tackle balance in an embodiment of the present invention.
Figure 5:
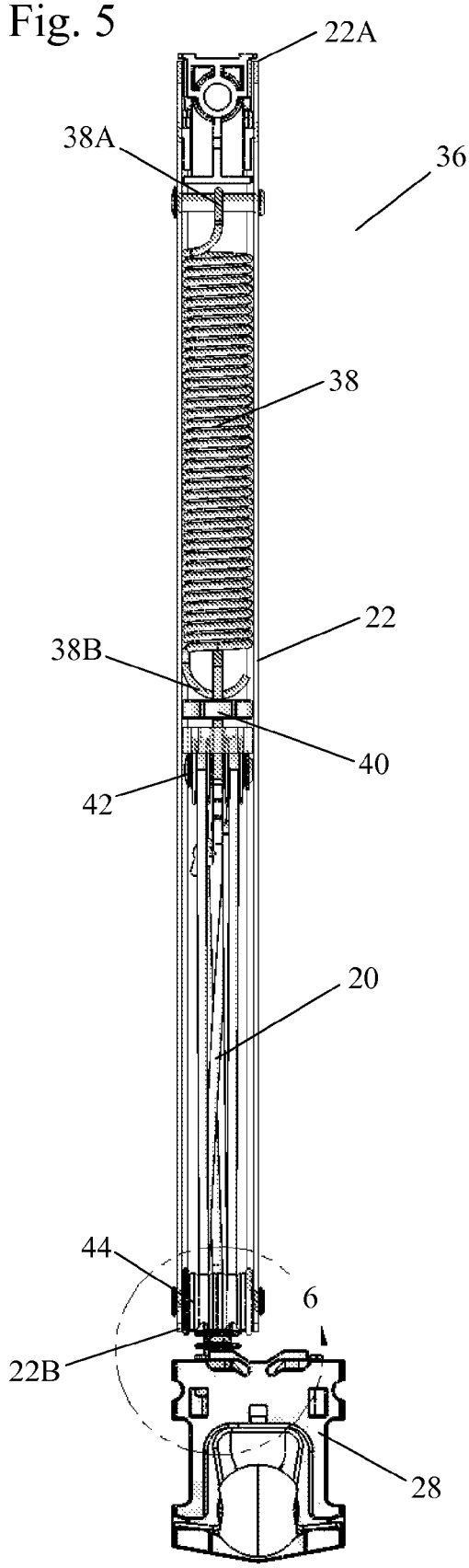
FIG. 5 shows a front view of the block and tackle balance of FIG. 3.
Figure 4:
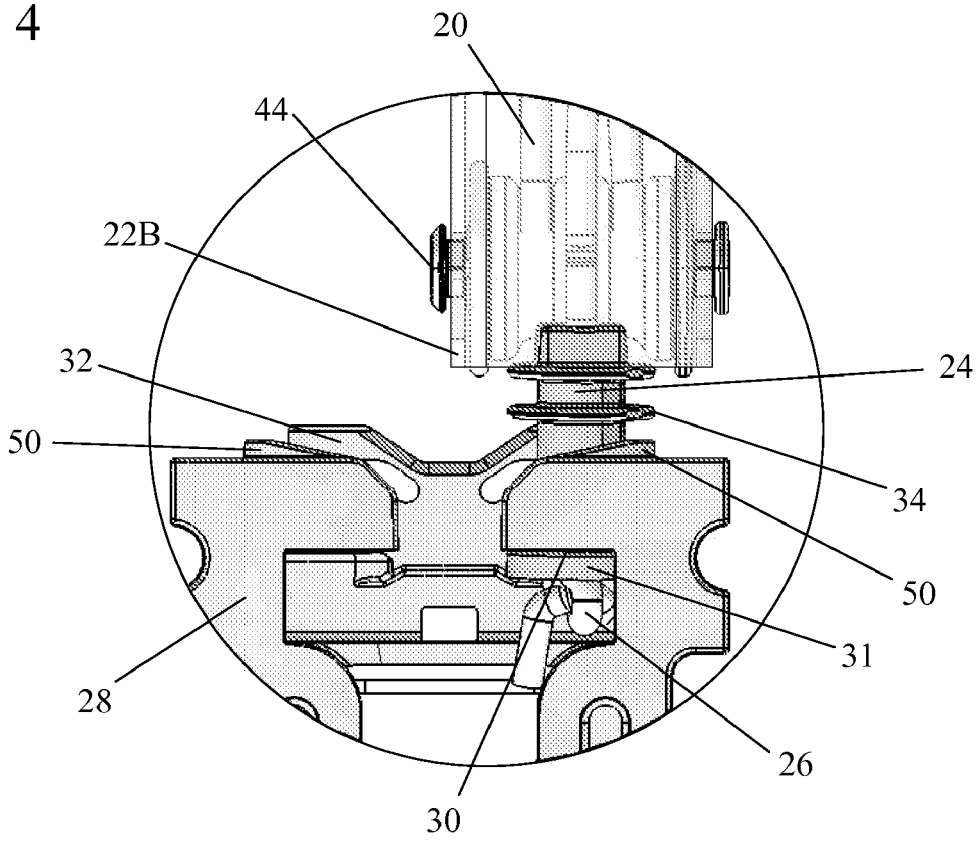
FIG. 4 shows an expanded view of the circle region 4 of FIG. 3.
Figure 6:
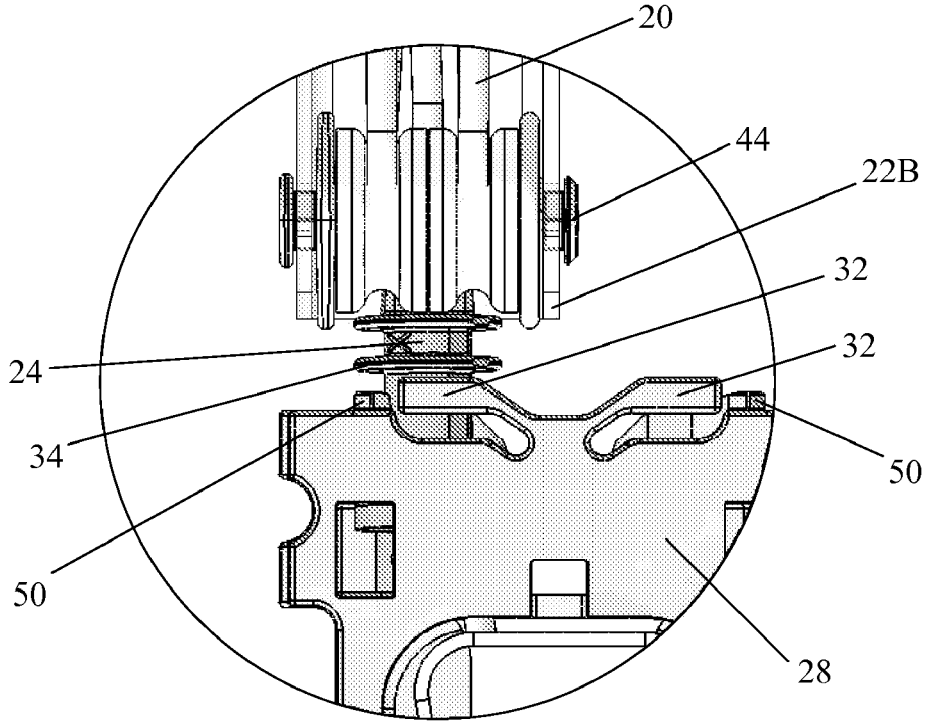
FIG. 6 shows an expanded view of the circle region 6 of FIG. 5.
Figure 8:
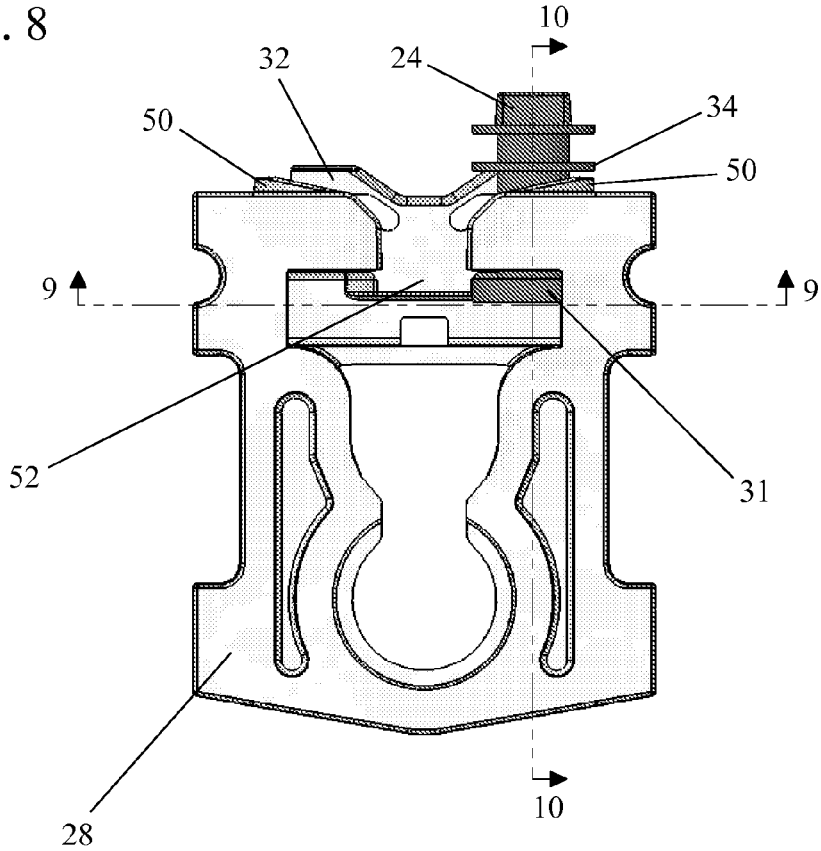
FIG. 8 shows a back view of a shoe and terminal connector in an embodiment of the present invention.
Figure 9:
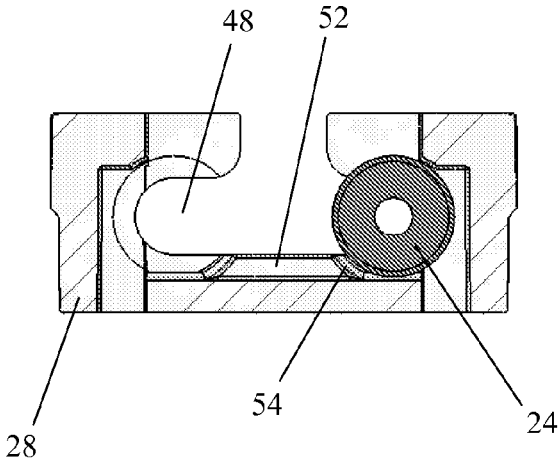
FIG. 9 shows a cross sectional view taken along the plane 9-9 of FIG. 8.
Figure 10:
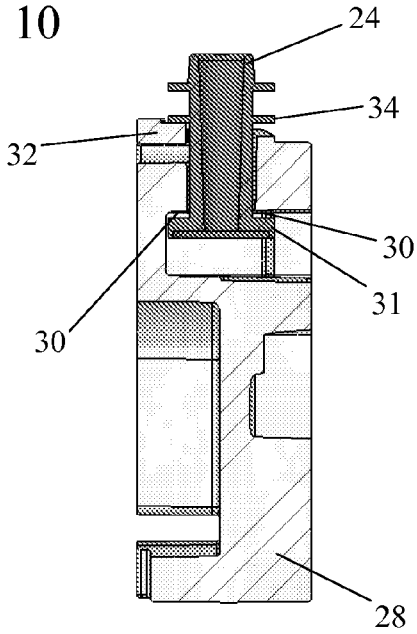
FIG. 10 shows a cross sectional view taken along the plane 10-10 of FIG. 8.

Referring to FIG. 3 and FIG. 5, the terminal connector 24 and shoe 28 are preferably part of a block and tackle balance assembly 36 further including the block and tackle channel 22, commonly formed from sheet metal, into which a spring 38 and the pulley system of the sash cord 20 are assembled. The first spring end 38A of the spring 38 may be affixed by various means proximate a first end 22A of the channel 22. The second spring end 38B is attached to a middle carriage 40, which includes a middle axle 42. The sash cord 20 is laced around the middle axle 42 and an end axle 44, which is affixed proximate a second end 22B of the channel 22. In conventional block and tackle balances, the sash cord 20 is affixed at one end to the middle carriage 40 and twice passes alternatively around sheaves including the end axle 44 and the middle axle 42, exiting finally at the second end 22B of the channel 22.

During assembly of the block and tackle balance, the terminal connector 24 is preferably inserted through a gap 46 in the shoe 28 with the widened portion 31 below an extension 52 on the shoe 28. The terminal connector 24 is then slid laterally toward the pocket 48 with the ridge 34 increasingly depressing the tab 32 until the widened portion 31 clears the extension 52. The terminal connector 24 is then raised in the pocket 48, aided by the bias of the tab and thereby decreasing depression of the tab 32, until an upper surface of the widened portion 31 contacts the retaining surface 30. The extension 52 preferably has a locating surface 54 lateral to the widened portion 31 to hold the terminal connector 54 in the pocket 48. The top surface of the shoe 28 preferably has a tab support 50 lining at least part of the top edge of the pocket 48. The tab support 50 resists excessive downward flexing and potential fracturing of the tab 32 by resisting excessive downward motion of the mounted terminal connector 24. The tab support 50 combines with the tab 32 to resist downward motion of the terminal connector 24 after the terminal connector has deflected the tab 32 downward enough that the terminal connector 24 contacts the tab support 50. In the embodiment of FIGS. 3 through 10, the tab support 50 ramps upward from a top edge of the pocket 48 near the gap 46 toward the edge where the tab 32 is located. Alternatively, the tab support 50 may have other shapes, including but not limited to a horizontal, stepped, or curved profile, within the spirit of the present invention to support the tab 32 in the case of any excessive downward force from the terminal connector 24. The tab support 50 is preferably rigidly fixed as a hard stop to prevent the tab 32 from flexing downward to the point that it breaks.

Although the shoe 28 in the embodiments of FIG. 3 through FIG. 10 has left-right symmetry and a pocket 48 and flexible tab 32 on each side for mounting of a terminal connector 24 on each side, a shoe may have only one pocket and one flexible tab for mounting a single terminal connector within the spirit of the present invention.

Figure 11:
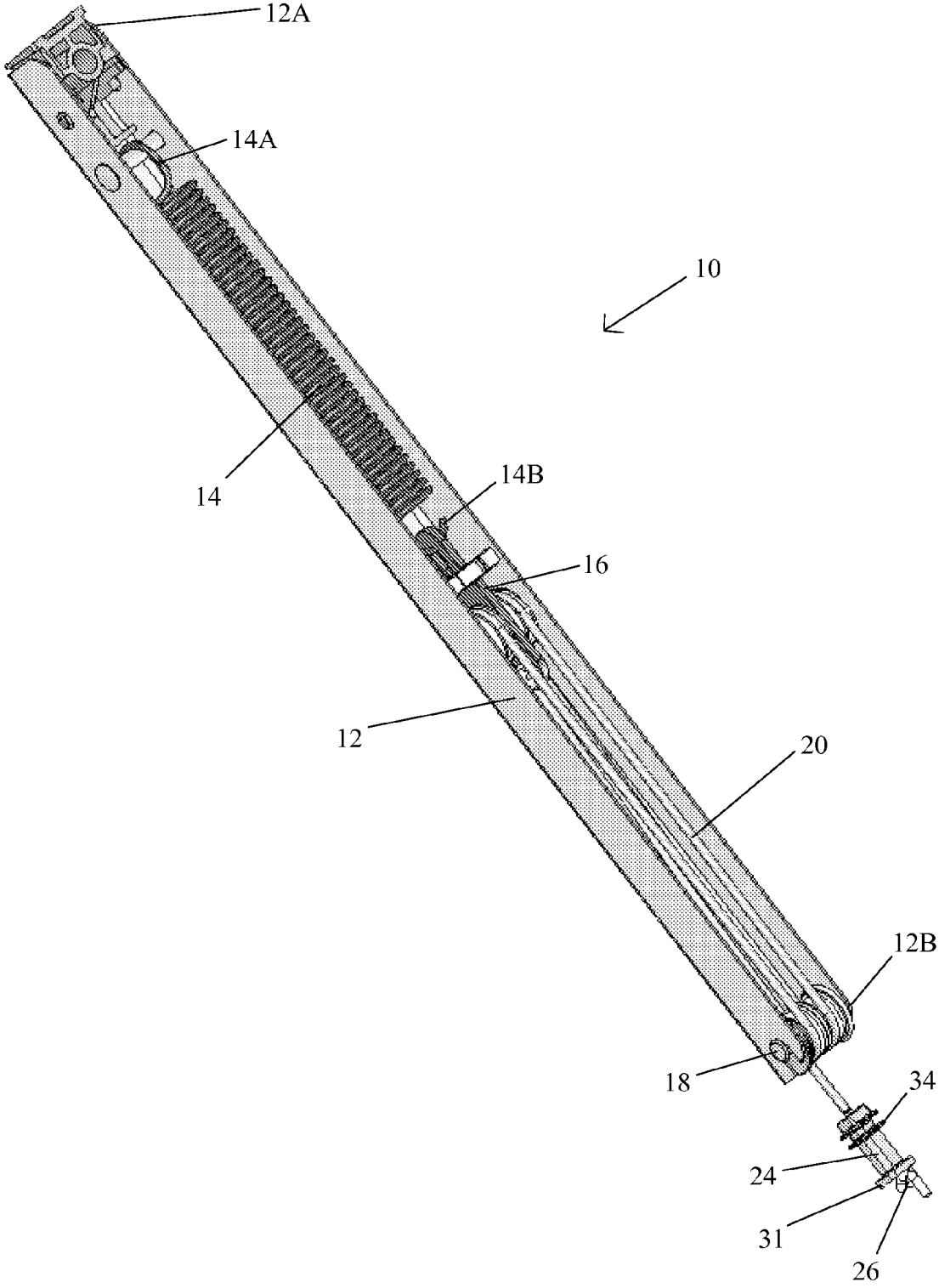
FIG. 11 shows a preferred block and tackle balance for use in the present invention.

FIG. 11 shows a preferred block and tackle balance 10 for use in the present invention. The balance 10 is constructed from a channel 12 into which a spring 14 is assembled. The first spring end 14A of the spring 14 may be affixed by various means proximate a first end 12A of the channel 12. The second spring end 14B of the spring 14 is attached to a middle carriage 16, the middle carriage 16 including the first portion of a multi-part balance tackle assembly. An end axle 18, including a second portion of the multipart balance tackle assembly is affixed proximate a second end 12B of the channel 12. The sash cord 20 is affixed at one end to the middle carriage 16 and passes alternatively around sheaves including the end axle 18 and the middle carriage 16. The sash cord 20 exits at the second end 12B of the channel 12, where it is attached to a terminal connector 24 with an axial bore, through which the cord 20 is threaded. The cord 20 is then secured 26 to maintain the terminal connector 24 on the cord 20. Although the cord is shown as knotted in FIG. 11 to maintain the terminal connector on the cord, any method to secure or attach the terminal connector to the cord, including, but not limited to, knotting, molding, adhering, clamping, and clasping, may be used within the spirit of the present invention. The widened portion 31 and the ridge 34 of the terminal connector 24 are also shown in FIG. 11.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A block and tackle window balance assembly comprising:

a terminal connector; and a balance shoe attached to the terminal connector, the balance shoe comprising a biasing element and a locating surface;

wherein when the terminal connector is in a mounted position in the balance shoe, the biasing element biases the terminal connector in an upward direction and the locating surface limits the lateral movement of the terminal connector such that the terminal connector is removable from the balance shoe only after overcoming the bias of the biasing element.

2. The assembly of claim 1, the balance shoe further comprising a retaining surface for limiting upward movement of the terminal connector when in the mounted position in the balance shoe.

3. The assembly of claim 1, wherein when the bias of the biasing element against the terminal connector is overcome, the terminal connector is lowered from the mounted position and a widened portion of the terminal connector laterally clears the locating surface.

4. The assembly of claim 1, wherein the terminal connector is attached to a sash cord.

5. The assembly of claim 1, wherein the block and tackle window balance assembly is an inverted block and tackle window balance assembly and further comprises a balance channel having substantially a U-shape in cross-section; and wherein the terminal connector is attached to the balance channel.

6. A block and tackle window balance assembly comprising:

a terminal connector attached to a sash cord; and a balance shoe comprising:

a biasing element for biasing the terminal connector in an upward direction toward the sash cord in a mounted position in the balance shoe;

a retaining surface for limiting upward movement of the terminal connector when mounted in the balance shoe; and a locating surface limiting lateral movement of the terminal connector in the balance shoe unless an upward bias of the biasing element is overcome such that the terminal connector is lowered from the mounted position and a widened portion of the terminal connector laterally clears the locating surface.

7. The assembly of claim 6, wherein the biasing element comprises a flexible tab extending substantially horizontally with respect to a top surface of the shoe.

8. The assembly of claim 7, wherein the flexible tab is deflected slightly downward by the terminal connector such that terminal connector is biased toward the mounted position in the balance shoe.

9. The assembly of claim 7, wherein the shoe further comprises a tab support extending upward from the top surface of the shoe along a pocket where the terminal connector is mounted.

10. The assembly of claim 9, wherein the tab support limits downward flexing and potential fracturing of the tab by resisting excessive downward motion of the terminal connector.

11. The assembly of claim 6, wherein the terminal connector further comprises a ridge applying a downward force to the biasing element when the terminal connector is in the mounted position.

12. The assembly of claim 6, wherein the retaining surface contacts an upper surface of the widened portion to limit upward movement of the terminal connector in the mounted position.

13. The assembly of claim 6 further comprising:

a balance channel having substantially a U-shape in cross-section; and a spring affixed at a first spring end near a first end of the channel and at a second spring end opposite the first spring end to a middle carriage;

wherein the sash cord is attached at a first cord end to the middle carriage and laced around a middle axle attached to the middle carriage and an end axle mounted in the channel near a second end of the channel opposite the first end;

wherein the terminal connector is attached to a second cord end of the sash cord opposite the first cord end; and wherein the sash cord exits the channel at the second end of the channel.

14. The assembly of claim 13, wherein the terminal connector inserts into a gap in the shoe and is mounted in a pocket of the shoe.

15. The assembly of claim 13, wherein the sash cord is threaded through a central bore in the terminal connector and knotted to attach the terminal connector to the second cord end of the sash cord.

16. The assembly of claim 13, wherein the terminal connector is molded around the second cord end of the sash cord.

17. A method of assembly of a block and tackle window balance comprising the steps of:

a) inserting a terminal connector for attachment to a sash cord through gap in a balance shoe;

b) moving the terminal connector laterally toward a pocket of the balance shoe with a widened portion of the terminal connector remaining below an extension on the balance shoe while a ridge of the connector increasingly applies a downward force to a biasing element of the balance shoe until the widened portion clears the extension; and c) raising the terminal connector upward in the pocket to a mounted position, thereby decreasing loading of the biasing element, wherein a retaining surface of the balance shoe limits upward movement o the terminal connector and a locating surface on the extension limits lateral movement of the widened portion when the terminal connector is in the mounted position.

18. The method of claim 17, further comprising the step of threading the sash cord through a central bore in the terminal connector and knotting a cord end to attach the terminal connector to the sash cord.

19. The method of claim 17, further comprising the step of molding the terminal connector around a cord end of the sash cord.

20. A method of maintaining a terminal connector in a mounted position in a balance shoe of a block and tackle window balance assembly, the method comprising the steps of:

a) applying an upward bias to the terminal connector in the mounted position using a biasing element of the balance shoe; and b) limiting lateral movement of the terminal connector in the mounted position by a locating surface extending from the balance shoe toward a widened portion of the terminal connector unless the upward bias is overcome such that the terminal connector is lowered from the mounted position and the widened portion laterally clears the locating surface.

* * * * *